US008610529B2

(12) United States Patent
Bertram

(10) Patent No.: US 8,610,529 B2
(45) Date of Patent: Dec. 17, 2013

(54) COMPACT PLANAR VHF/UHF POWER IMPEDANCE TRANSFORMER

(75) Inventor: Pierre Bertram, Creil (FR)

(73) Assignee: Thales, Neuilly sur Seine (FR)

( * ) Notice: Subject to any disclaimer, the term of this patent is extended or adjusted under 35 U.S.C. 154(b) by 0 days.

(21) Appl. No.: 13/513,801

(22) PCT Filed: Dec. 3, 2010

(86) PCT No.: PCT/EP2010/068808

§ 371 (c)(1),
(2), (4) Date: Aug. 7, 2012

(87) PCT Pub. No.: WO2011/067368

PCT Pub. Date: Jun. 9, 2011

(65) Prior Publication Data

US 2013/0169402 A1 Jul. 4, 2013

(30) Foreign Application Priority Data

Dec. 4, 2009 (FR) ..... 09 05875

(51) Int. Cl.
*H01F 27/29* (2006.01)
*H01F 27/28* (2006.01)
*H01F 21/02* (2006.01)

(52) U.S. Cl.
USPC ..... 336/200; 336/192; 336/232; 336/148; 336/147

(58) Field of Classification Search
USPC ..... 336/200, 192, 232, 148, 147
See application file for complete search history.

(56) References Cited

U.S. PATENT DOCUMENTS

| | | | | |
|---|---|---|---|---|
| 4,035,695 | A * | 7/1977 | Knutson et al. | 361/782 |
| 5,426,404 | A * | 6/1995 | Kommrusch et al. | 333/246 |
| 5,497,137 | A * | 3/1996 | Fujiki | 336/200 |
| 6,278,340 | B1 * | 8/2001 | Liu | 333/26 |
| 6,396,362 | B1 * | 5/2002 | Mourant et al. | 333/25 |
| 2003/0020568 | A1 * | 1/2003 | Mizutani et al. | 333/204 |
| 2006/0145786 | A1 * | 7/2006 | Wu | 333/190 |

FOREIGN PATENT DOCUMENTS

| | | | |
|---|---|---|---|
| EP | 1383145 | A1 | 1/2004 |
| WO | 03/088410 | A1 | 10/2003 |

OTHER PUBLICATIONS

Stefan Von Der Mark, et al.: "Three Stage Wakeup Scheme for Sensor Networks," 2005 SBMO/IEEE MTT-S, International Microwave and Optoelectronics Conference (IMOC), pp. 203-206.

* cited by examiner

*Primary Examiner* — Elvin G Enad
*Assistant Examiner* — Kazi Hossain
(74) *Attorney, Agent, or Firm* — Baker and Hostetler LLP

(57) ABSTRACT

An RF impedance transformer having a parallel low-impedance access Eb and serial high-impedance access Eh and intended for connection onto a printed circuit. The transformer includes a multilayer circuit that includes a long side and at least three layers. A first outer layer is separated from a second outer layer of the same thickness by at least one inner layer having a thickness at least four times greater than the thickness of the outer layers, each outer layer comprising an electrical conductor on each surface for forming a microstrip line, the serial high-impedance access Eh and the parallel low-impedance access Eb being on the long side of the multilayer circuit and near to each other so as to limit the area for connection with the printed circuit.

10 Claims, 7 Drawing Sheets

COMPACT PLANAR VHF/UHF POWER IMPEDANCE TRANSFORMER

CROSS-REFERENCE TO RELATED APPLICATIONS

This application is a National Stage of International patent application PCT/EP2010/068808, filed on Dec. 3, 2010, which claims priority to foreign French patent application No. FR 09 05875, filed on Dec. 4, 2009, the disclosures of each of which are incorporated by reference in their entireties.

FIELD OF THE DISCLOSED SUBJECT MATTER

The invention concerns radio-frequency devices operating in the VHF and UHF frequency bands and in particular an impedance transformer for wideband RF amplifiers.

BACKGROUND

Radio-frequency (RF) amplifier circuits employ impedance matching networks (also known as impedance transformers) in order to optimize the transfer of power between an RF source, RF amplifier transistors and a load. In the case of very wide bandwidths, these impedance transformers are generally produced with the aid of transmission lines that often take the form of interconnected coaxial cables.

For example, wideband RF amplifiers use, notably in the case of high powers, transistors connected in push-pull, each having a signal input and a balanced power RF output. Their RF inputs and outputs have impedances much lower than that of the usual 50Ω transmission lines. The use of impedance transformers at the input and output of the amplifier transistor therefore proves necessary to obtain an optimum transfer of power.

FIG. 1 is a diagram of one embodiment of a typical push-pull RF amplifier stage using such transformers.

The amplifier stage of FIG. 1*a* includes two amplifier transistors A and B connected in push-pull, an input transformer Te and an output transformer Ts with symmetrical inputs and outputs to adapt the input and output impedances, respectively, of the amplifier stage, by means of an input balun Be and an output balun Bs, to the low input and output impedances of the transistors A and B. The input balun Be and the output balun Bs provide respective connections between the unbalanced input E and output S of the amplifier and the balanced accesses of the transformers.

A generator with an impedance of 50Ω applies an RF signal to be amplified to the unbalanced input E of the input balun Be forming the input of the amplifier. The unbalanced output S of the output balun Bs forming the output of the amplifier stage is applied to a 50Ω load.

Note that the term "balun" is a contraction of the words BALanced and UNbalanced.

FIG. 2*a* is a diagram of one example of a prior art coaxial line impedance transformer.

The transformer in FIG. 2*a* effects impedance transformation from a high-impedance access Eh to a low-impedance access Eb, and in this example the impedance of the access Eh is 50Ω and the impedance of the access Eb is 12.5Ω. The transformer in FIG. 2*a* includes two coaxial lines L1, L2 with characteristic impedance Zc=25Ω each including an internal conductor Ci and an external conductor Ce surrounding the internal conductor.

The two lines L1, L2 are connected in series on the high-impedance access Eh side and in parallel on the low-impedance access Eb side. To this end, on the high-impedance access side of the transformer, the external conductors Ce of the two lines L1, L2 are connected together and possibly to a reference potential, for example ground M. On the low-impedance access side of the transformer, the internal conductor Ci of one of the lines is connected to the external conductor Ce of the other line and vice versa. RF signal input and output are effected in balanced mode via the two internal conductors Ci of the coaxial lines.

The impedance transformation ratio remains fixed, theoretically equal to 4 in the case of the transformer in FIG. 2*a*.

The use of ferrite blocks around the coaxial lines (not shown in the figure) enables the bandwidth of the transformer to be widened at the low-frequency end.

FIG. 2*b* is a simplified layout diagram of an RF amplifier stage.

The amplifier stage includes, on a printed circuit 10, an integrated circuit 20 with two transistors to be connected in push-pull, an input transformer T1 and an output transformer T2 as in the FIG. 2*a* diagram.

The input transformer T1 includes two lines Le1 and Le2 connected in series on its high-impedance access Eh side and in parallel on its low-impedance access Eb side, as shown in FIG. 2*b*. The internal conductors Ci of the two lines connect the inputs e1, e2 of the two transistors in the integrated circuit 20 via a matching unit 24.

The output transformer T2, constructed like the input transformer T1, includes two coaxial lines Ls1 and Ls2 and is connected by its low-impedance access Eb to the outputs s1, s2 of the transistors in the integrated circuit 20, its high-impedance access Eh being intended to be connected to a load that is not shown in the figure.

The lines Le1, Le2, Ls1, Ls2 of the transformers T1, T2 are coiled here to reduce their overall size within the amplifier.

The FIG. 2*b* type embodiment using coiled coaxial line transformers is still of the hand-wired variety, which impact on the production cost and the overall size (above all in length) of the amplifier stage.

To limit the overall size of RF impedance transformers, some prior art embodiments use printed circuits to replace the coaxial lines. There are very many such embodiments and some are commercially available, but for modest bandwidths and above all modest powers.

Only two particular examples will be cited, on the basis of which the advantages of the proposed invention will be described.

FIGS. 3*a* and 3*b* are views in cross section and in elevation of a prior art embodiment of an impedance transformer described by Georg Boeck in 0-7803-9342-2/05/$20.00 © 2005 IEEE.

The impedance transformer in FIG. 3*a* is produced on a multilayer printed circuit 30 with four metalized layers integrating rectangular microstrip type lines.

FIG. 3*a* is a view in cross section of the printed circuit with four layers in an area including lines with an impedance $Z_L$ of 25Ω and lines with an impedance $Z_L$ of 50Ω.

These rectangular coaxial lines may have impedances $Z_L$ of 25Ω or 50Ω depending on the chosen disposition, thus enabling integration into a 50Ω circuit of the transformer that uses 25Ω lines.

FIG. 3*b* is a plan view of the impedance transformer from FIG. 3*a*. The microstrip lines are interleaved in a spiral in order to reduce their overall size, which necessitates numerous crossings of lines compromising performance and power rating. Vias 32 interconnect the metallizations of the various layers of the printed circuit.

The embodiment of FIGS. 3*a* and 3*b* is suitably only for uses with a very low signal level because of the spiral topology used, compromising performance, notably in terms of insertion losses.

FIG. 4*a* is a perspective view of another prior art embodiment of an impedance transformer. FIG. 4*b* is a view in cross section of the transformer from FIG. 4*a*.

In the FIG. 4*a* embodiment the problem of many crossing lines of the embodiment of FIGS. 3*a* and 3*b* does not arise because of an embodiment topology based on a single pair of tracks forming lines bent to a U-shape. To this end, the transformer in FIGS. 4*a* and 4*b* includes a double-sided substrate 40 having metallization on both faces forming microstrip type lines L1, L2 interconnected by conductive transitions between faces.

The FIG. 4*a* embodiment includes:

a conductor (or metallization) 308 on one face 44 of the substrate 40 and another conductor 316 facing the first on the other face 46 of the substrate 40 to form the first U-shaped microstrip line L1, a second microstrip line L2 including one conductor (or metallization) 304 on the face 44 of the substrate and another conductor 316 facing the first on the other face of the substrate 40 to form the second U-shaped microstrip line L2 symmetrical to the first L1.

At one end 50 of the substrate, the free ends of the conductors 308, 304 on the same face 44 of the substrate 40 of the two lines L1, L2 form serial input ports 5, 3 (high-impedance accesses), and the ends of the conductors 316, 312 on the other face 46 of the substrate 40 are connected together to form a port 4 or common point.

At the other end of the substrate 52 opposite the first end 50, the end of the conductor 304 of the line L2 on the face 44 of the substrate 40 and the end of the conductor 316 of the line L1 on the other face 46 of the substrate 40 are connected together to an output port 2 and the end of the conductor 312 of the line L2 on the other face 46 of the substrate and the end of the conductor 308 of the line L1 on the face 44 of the substrate are connected together to a port 1, the ports 1 and 2 forming the parallel low-impedance access of the transformer in FIG. 3*a*.

This other embodiment of FIGS. 4*a* and 4*b*, although it enables a good power rating, has the drawback of being bulky and furthermore the impedance transformation ratio remains fixed (theoretically equal to 4).

SUMMARY

To reduce the volume necessary for installing an RF impedance transformer the invention proposes an impedance transformer operating in the VHF and UHF frequency bands having a parallel low-impedance access Eb and a serial high-impedance access Eh, both intended to be connected to a printed circuit, characterized in that it is constituted of a multilayer circuit having a long side for its connection to the printed circuit, at least three layers, a first outer layer separated from a second outer layer of the same thickness by at least one inner layer of thickness at least four times greater than the thickness of the outer layers, each outer layer having two metalized faces to form electrical conductors, an internal face including an internal electrical conductor and an external face including an external electrical conductor facing the internal electrical conductor to form a microstrip line on each of the two outer layers, the two microstrip lines being symmetrical with respect to a central plane of the multilayer circuit parallel to the external faces, the multilayer circuit including:

at two facing ends of the microstrip lines, a respective electrical connection between the end of the internal conductor of one microstrip line and the end of the external conductor of the other microstrip line to produce the parallel low-impedance access Eb, at the facing other two ends of said microstrip lines, another electrical connection between the ends of the internal electrical conductors of the two microstrip lines, to produce the serial high-impedance access Eh, both ends of the microstrip lines, respectively including the parallel low-impedance access Eb and the serial high-impedance access Eh, being on the long side of the multilayer circuit and close to each other to limit the area of connection with the printed circuit.

The symmetrical microstrip lines advantageously have impedances varying progressively between their two ends from a low impedance to a high impedance in order to modify the impedance transformation ratio.

In one embodiment of the impedance transformer, for technology reasons, the inner layer is constituted of two superposed layers, to form a perfectly symmetrical multilayer circuit with four layers.

In another embodiment the electrical conductors of the microstrip lines are at least partially of serpentine shape along a common axis XX' parallel to the long side of the multilayer circuit including the high-impedance access Eh and the low-impedance access Eb, to reduce the size of the multilayer circuit.

In another embodiment the widths of the external and internal conductors vary progressively from one of their ends to the other along the microstrip lines, from a certain initial width to a smaller final width to obtain the progressive variation from the low impedance to the high impedance of the microstrip lines.

In another embodiment the electrical conductors of the microstrip lines include:

straight first parts perpendicular to the long side of the multilayer circuit including the ends of the electrical conductors forming the high-impedance access Eh and the low-impedance access Eb, second parts, on either side of the high-impedance access Eh and the low-impedance access Eb, of serpentine shape along an axis XX' parallel to the long side of the multilayer circuit, straight third portions parallel to the axis XX' over the portions of the electrical conductors of serpentine shape.

In another embodiment the long side of the multilayer circuit includes a respective cut-out, on either side of the high-impedance access Eh and the low-impedance access Eb, of depth P having edges parallel to the long side, said cut-outs being produced to leave room, under the transformer, for any components situated on the printed circuit (also known as the mother board) to which the transformer is intended to be connected.

In another embodiment the thickness of each of the outer layers is 100 μm, the thickness of the inner layer being 1600 μm.

In another embodiment the inner layer is formed by two superposed inner layers each 800 μm thick.

In another embodiment the transformation ratio Rz between the impedance of the high-impedance access Eh and that of the low-impedance access Eb may be in the range 2 to 9.

BRIEF DESCRIPTION OF THE DRAWINGS

The invention will be better understood in the light of the description of an impedance transformer of one embodiment of the invention given with reference to the appended figures, in which.

DETAILED DESCRIPTION

Figure 5A:
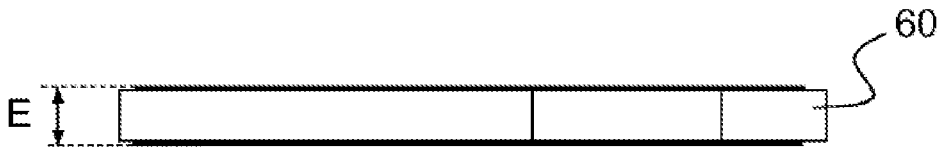
FIG. 5*c* is a partial cross-sectional view of the multilayer circuit of the transformer from FIG. 5*a*, FIGS. 5*d* and 5*e* show the interconnection between conductors of the transformer from FIGS. 5*a*, 5*b* and 5*c*.
Figure 5B:
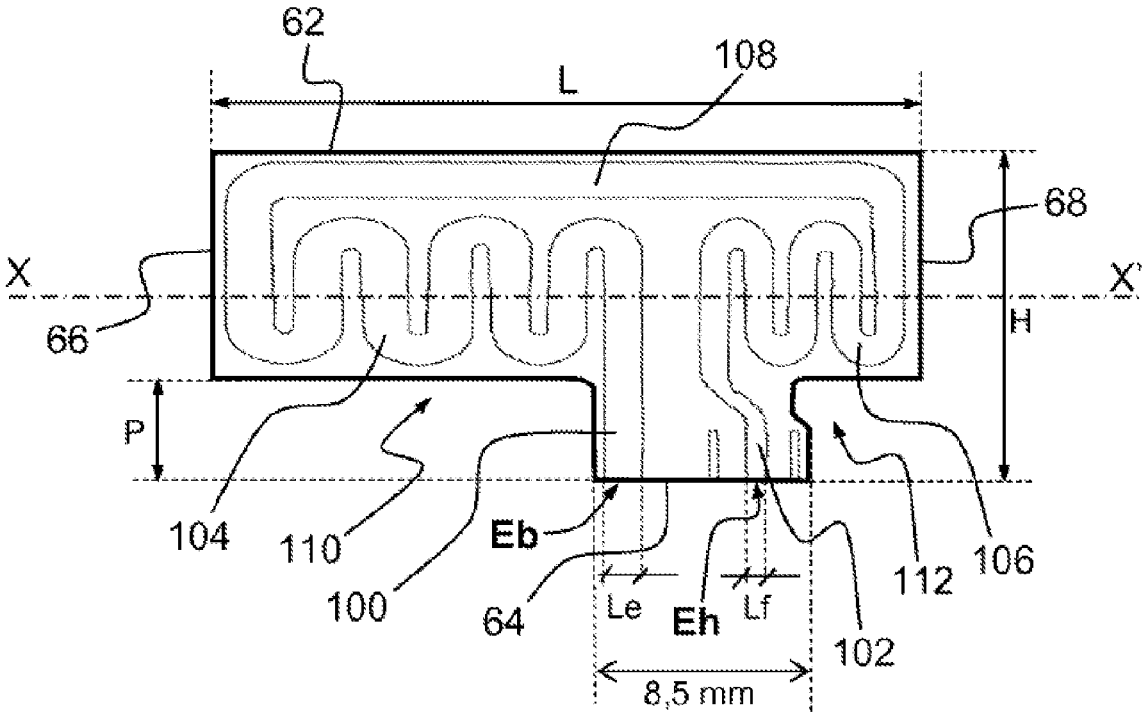

FIGS. 5*a* and 5*b* are respectively a bottom view and a front view of an RF transformer of the invention including a multilayer circuit.

Figure 5C:
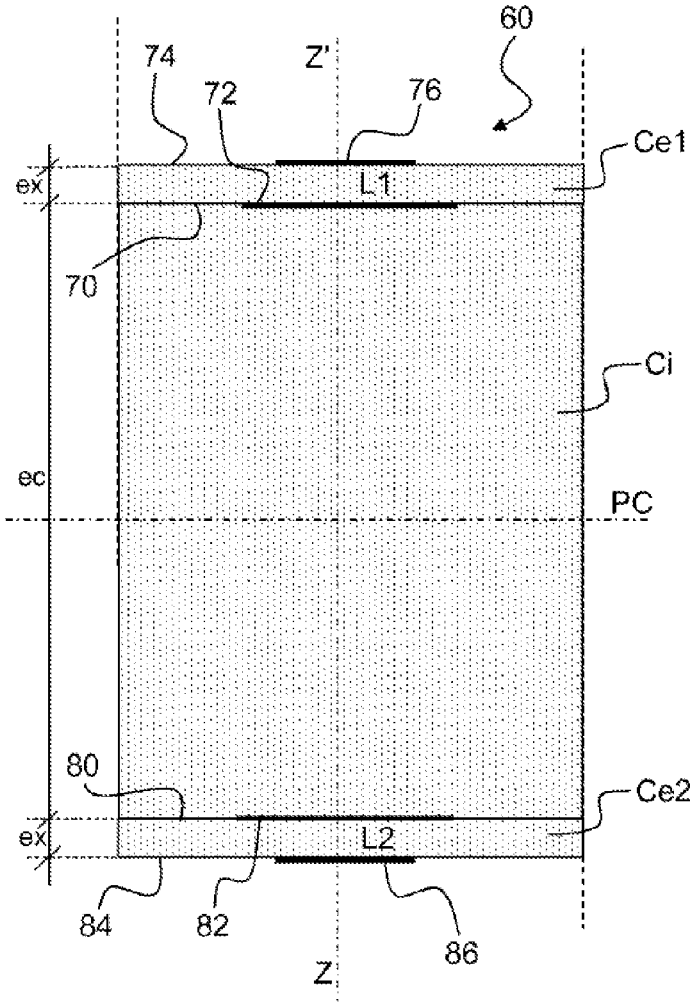

FIG. 5*c* is a partial cross-sectional view of the multilayer circuit of the transformer from FIG. 5*a*.

The transformer from FIGS. 5*a* and 5*b* includes a rectangular multilayer substrate 60 of length L, height H and thickness E, having two parallel long sides 62, 64 and two short sides 66, 68 perpendicular to the long sides.

In this embodiment, the transformer includes three superposed layers (see FIG. 5*c*), a first outer layer Ce1 separated from a second outer layer Ce2, of the same thickness ex, by an inner layer Ci of thickness ec very much greater than that of the outer layers.

An inner layer Ci with a thickness very much greater than or substantially greater than the thickness of the outer layers Ce is such that the thickness of this inner layer Ci is at least four times greater than the thickness of the outer layer.

By way of example, in the embodiment of the multilayer circuit shown in section in FIG. 5*c*, the thickness of each of the outer layers is ex=100 μm, and the thickness of the inner layer is ec=1600 μm. The inner layer Ci may also be formed by two superposed inner layers each of 800 μm.

The first outer layer Ce1 includes two metalized faces, an internal face 70 having a metallization forming an internal conductor 72 and an external face 74 having a metallization forming an external conductor 76 facing the internal conductor. The internal and external conductors 72, 76 of the first outer layer Ce1 form a first microstrip type line L1.

The second outer layer Ce2 includes two metalized faces, an internal face 80 having a metallization forming an internal conductor 82 and an external face 84 having a metallization forming an external conductor 86 facing the internal conductor. The two conductors 82, 86 of the second outer layer Ce2 form a second microstrip type line L2 symmetrical with the first with respect to a plane of symmetry PC of the multilayer circuit 60 parallel to and equidistant from the external faces 74, 84.

In this embodiment the electrical conductors 72, 76, 82, 86 of the outer layers are superposed via the various layers Ce1, Ci, Ce2 of the multilayer circuit 60.

In the transformer from FIG. 5*b*:

on the one hand, the metallizations of the outer layers of the multilayer circuit forming the electrical conductors 72, 76, 82, 86 have widths varying progressively from one end to the other of the lines L1 and L2, from a certain initial width Le to a smaller final width Lf, to obtain a progressive variation of the impedance of the lines L1, L2 between their two ends, from a low impedance Zb at the end of initial width Le to a high impedance Zf at the other end of smaller final width Lf, on the other hand, the ends of said electrical conductors 72, 76, 82, 86 are on the same edge of a long side 64 of the multilayer circuit 60 in a central area of said multilayer substrate (see FIG. 5*b*).

The metallizations of the outer layers Ce1, Ce2 are produced to obtain a short length L of the multilayer substrate 60 but complying with a maximum height H not to be exceeded for the integration with or connection to a printed circuit (or mother board) to which the transformer will be connected, as described hereinafter.

To this end, in this embodiment, as shown in FIG. 5*b*, the electrical conductors of the lines L1, L2 include:

straight first parts 100, 102 perpendicular to the long side 64 of the multilayer circuit 60 including the ends of the electrical conductors forming the high-impedance access Eh and the low-impedance access Eb, second parts 104, 106 on either side of the high-impedance access Eh and the low-impedance access Eb, of serpentine shape along an axis XX' parallel to the long side 64 of the multilayer circuit 60, straight third parts 108 parallel to the axis XX' over the parts of the electrical conductors of serpentine shape.

The multilayer circuit 60 includes, on the side of the high-impedance access Eh and the low-impedance access Eb of the transformer, a respective cut-out 110, 112 on either side of said ports, of depth P, each of these cut-outs having edges parallel to the long sides 62, 64.

The cut-outs 110, 112 are produced to leave room under the transformer for any components wired to the printed circuit (or mother board) to which the transformer is intended to be connected.

The multilayer circuit 60 includes vias interconnecting the ends of the electrical conductors to produce floating ports, the serial high-impedance access Eh at one end of the lines L1 and L2 and the parallel low-impedance access Eb at the other end of the lines L1 and L2.

Figure 5D:
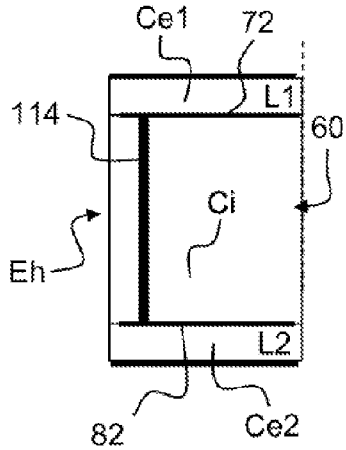
Figure 5E:
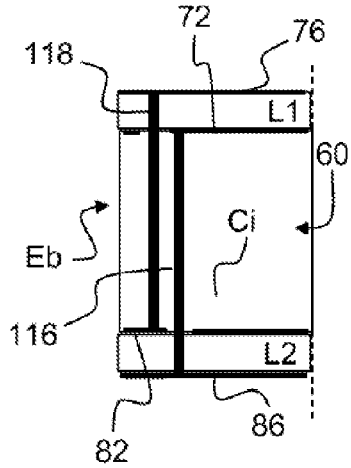

FIGS. 5*d* and 5*e* show the interconnection between conductors of the transformer from FIGS. 5*a*, 5*b* and 5*c*.

The narrower end of an internal conductor 72 of one of the lines L1 is connected by vias 114 through the central layer Ci of the substrate to the facing end of the internal conductor 82 of the other line L2 to produce the serial high-impedance access Eh.

The wider end of the internal conductor 72 of the line L1 is connected by vias 116 to the end of the facing external conductor 86 of the line L2 to form one of the two poles of the parallel low-impedance access Eb, the other pole being produced by the connection by means of vias 118 of the wider end of the internal conductor 82 of the line L2 to the facing external conductor 76 of the line L1.

The lines L1, L2 of the transformer have a varying width in order to obtain impedance (or transformation) ratios Rz different to (generally greater than) the ratio of 4 obtained by coaxial or microstrip lines having a constant width.

The lines of varying width of the transformer of the invention enable a transformation ratio Rz to be produced between the impedance of the high-impedance access Eh and that of the low-impedance access Eb in the range 2 to 9.

This way superposing the two pairs of conductors providing the lines L1, L2 by means of a thick substrate minimizes the coupling between them in order to prevent unwanted interaction. To this end, the central substrate layer Ci is substantially thicker than the external substrate layers Ce1, Ce2 of the multilayer circuit (thickness ratio of the order of 16 in the embodiment described).

Moreover, in this embodiment, the width of the internal electrical conductors 72, 82 is greater than the width of the external electrical conductors 76, 86 to obtain better decoupling between the two lines L1 and L2.

The inner layer Ci may also be produced by two bonded layers of the same thickness, which amounts to producing a multilayer substrate with four layers that is perfectly symmetrical, simple to manufacture and yields a product that is stable over time.

In this embodiment, the impedance of the serial high-impedance access Eh of the transformer is chosen to be slightly less than 50Ω, for example 46Ω, in order to have wider lines L1, L2 for a better power rating of the transformer. In this case, the input impedance Zf on the high-impedance side of each line L1 or L2 is 23Ω.

The impedance Zb of the low-impedance access of each line L1, L2 is chosen as 17Ω to obtain an impedance of 8.5Ω of the low-impedance access Eb of the transformer.

In this embodiment, the variation of the width of the tracks (or metallizations) between the high-impedance access Eh and the low-impedance access Eb of the transformer enables conversion from 46Ω to 8.5Ω, i.e. an impedance ratio of the order of 5.5.

A different embodiment of the transformer of the invention uses ferrite material placed in a central portion of the electrical conductors of the lines L1, L2 to extend the bandwidth at the low-frequency end, but this is achieved to the detriment of the cost.

Figure 6:
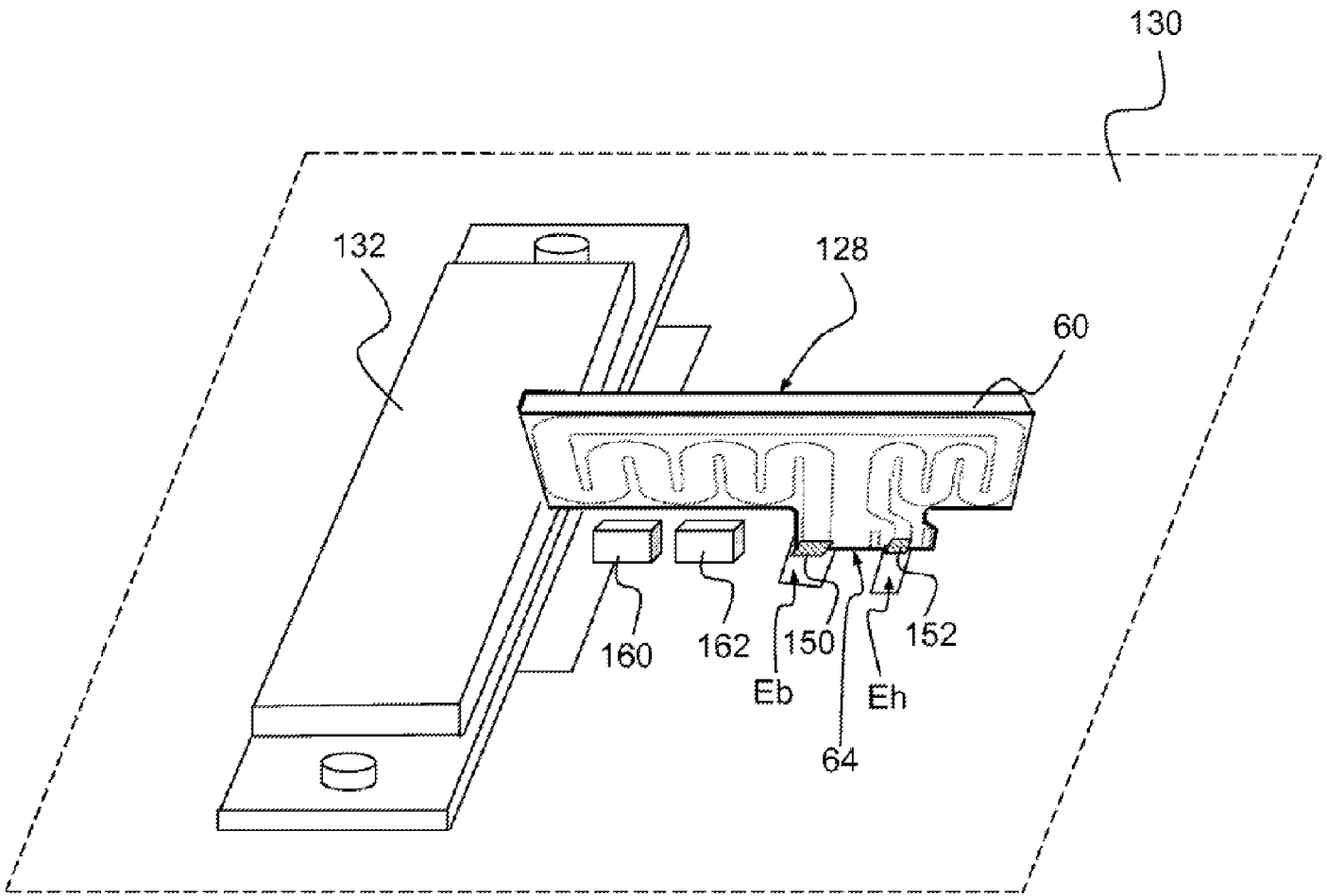
FIG. 6 is a simplified perspective view of an RF amplifier stage including the transformer of the invention from FIG. 5*b*.

FIG. 6 is a simplified perspective view of an RF amplifier stage including the transformer of the invention shown in FIG. 5*b*. The transformer in FIG. 6 takes the form of a daughter board 128.

The amplifier stage includes a printed circuit (or mother board) 130 on which is mounted an integrated circuit 132 including two transistors to be connected in push-pull.

The daughter board 128 plugs into the mother board 130 and only four soldered joints 150, 152 (only two of which are shown in the figure) are necessary at the ends of the external electrical conductors 72, 76 on the external faces 74, 80 of the multilayer circuit 60 to connect the lines L1, L2 of the transformer to the mother board. These soldered joints enable both connection to and immobilization of the daughter board 128 on the mother board 130, an asymmetrical shape of the daughter board 128 being an easy way to provide polarization.

The embodiment of the transformer proposed by way of example in FIGS. 5*a* and 5*b* is based on a circuit design enabling the use of a daughter board (multilayer circuit 60) intended to be attached vertically to the amplifier mother board 130 in FIG. 6. The thickness of this daughter board is of the order of 2 mm.

The design of the pairs of tracks for connecting the transformer of the invention enables the overall size of this daughter board to be minimized. The high-impedance access Eh and the low-impedance access Eb of the transformer 128 are notably very close together to reduce the length of the footprint on the mother board 130.

Figure 1:
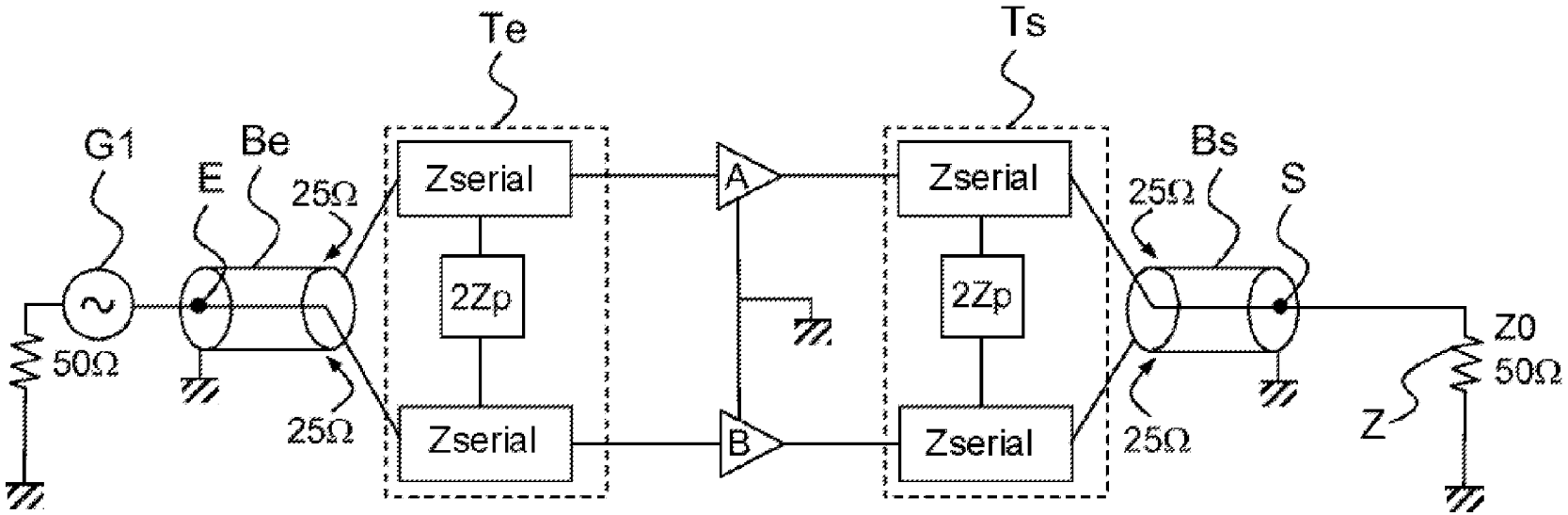
FIG. 1, already described, shows diagrammatically an embodiment of a prior art push-pull RF amplifier stage, FIG. 2*a*, already described, is a diagram of a prior art coaxial line impedance transformer, FIG. 2*b*, already described, is a simplified layout diagram of an RF amplifier stage, FIGS. 3*a* and 3*b*, already described, are cross-sectional and front views of a prior art embodiment of an impedance transformer, FIG. 4*a*, already described, is a perspective view of another embodiment of a prior art impedance transformer, FIG. 4*b*, already described, is a cross-sectional view of the transformer from FIG. 4*a*, FIGS. 5*a* and 5*b* are respectively a bottom view and a front view of an RF transformer of the invention including a multilayer circuit.
Figure 2A:
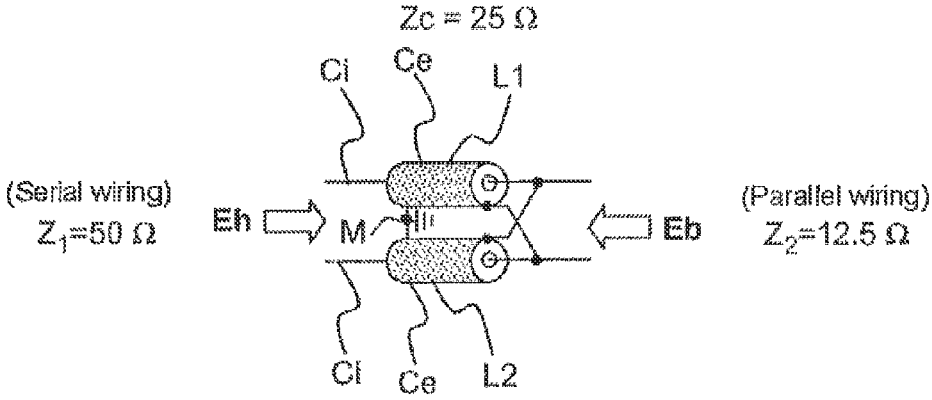
FIG.2a PRIOR ART
Figure 2B:
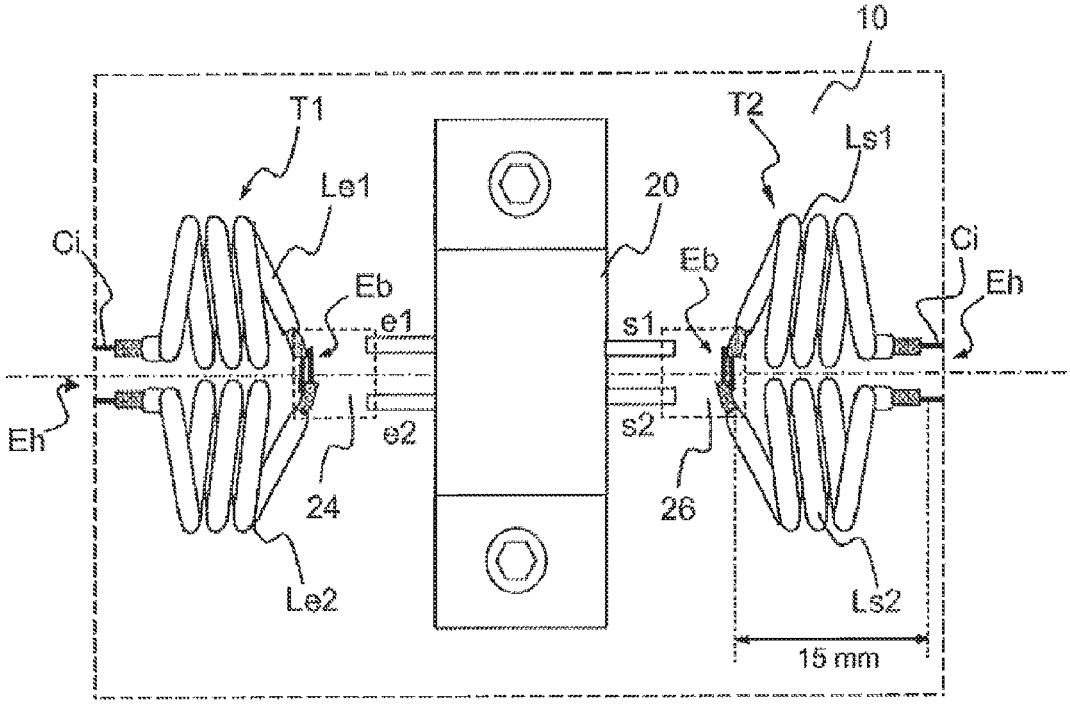
FIG.2b PRIOR ART
Figure 3A:
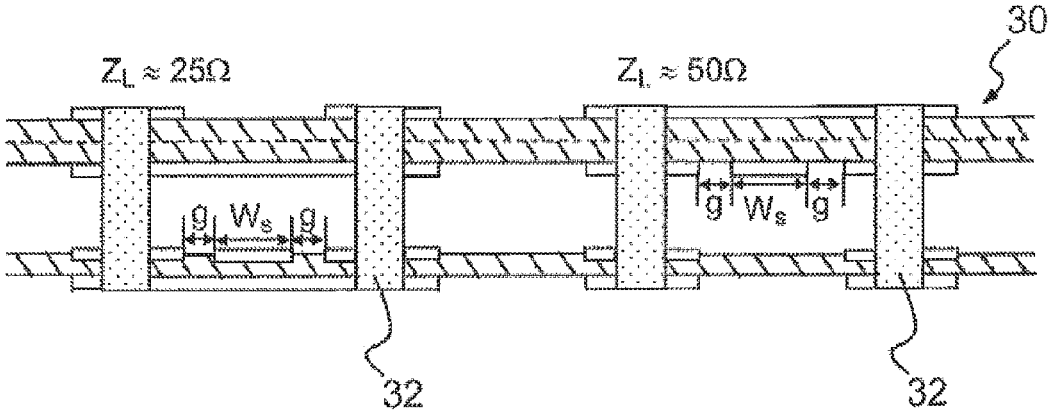
FIG.3a PRIOR ART
Figure 3B:
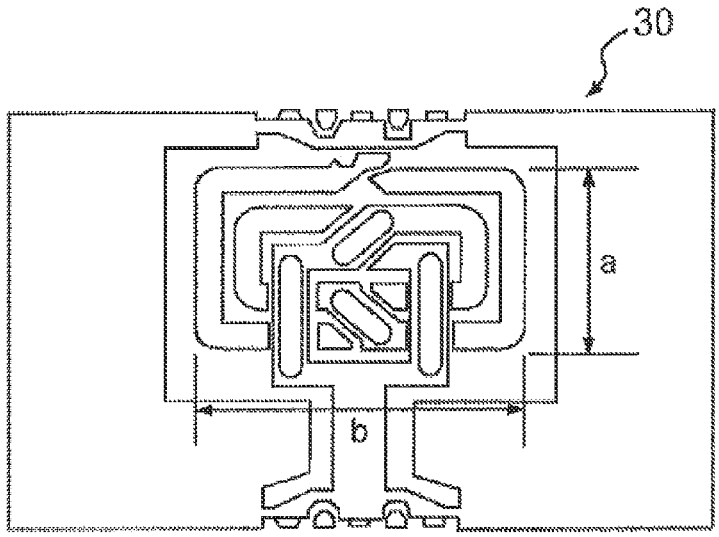
FIG.3b PRIOR ART
Figure 4A:
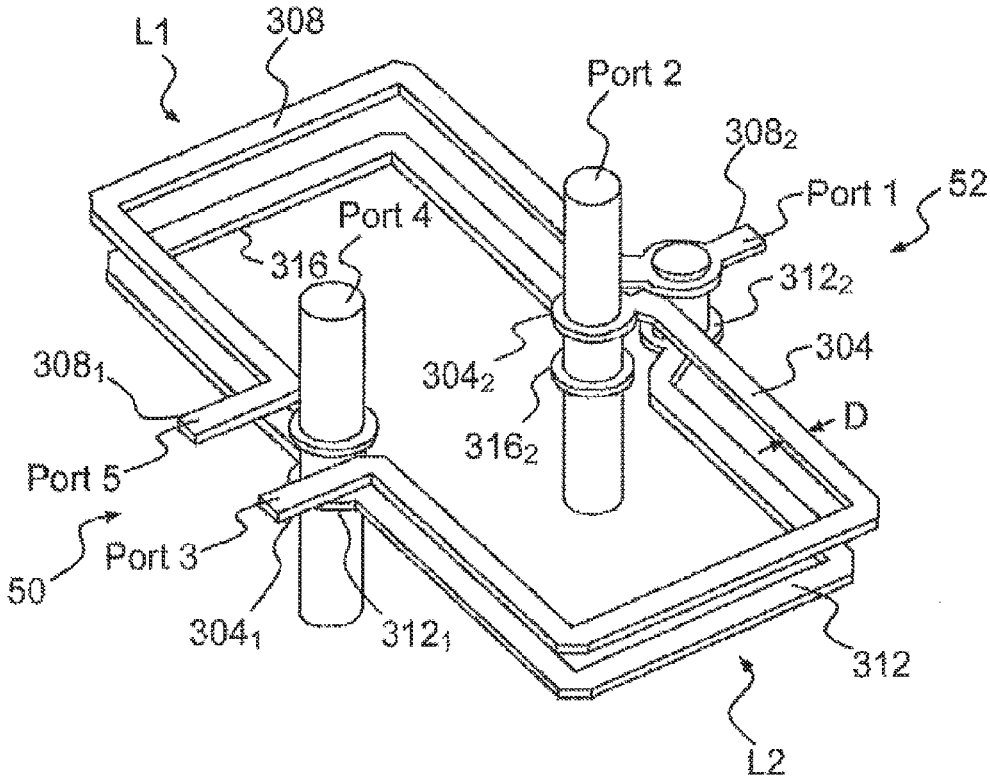
FIG.4a PRIOR ART
Figure 4B:
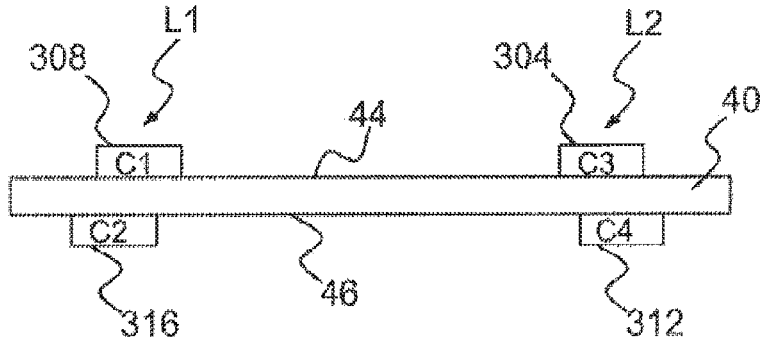
FIG.4b PRIOR ART

In the embodiment of FIGS. 5*a* and 5*b*, the length of the central portion of the substrate including the high-impedance access Eh and the low-impedance access Eb is 8.5 mm whereas the length necessary for the connection of the transformer with coiled lines Ls2 in FIG. 2*b* is much greater (of the order of 15 mm).

Finally, the asymmetrical shape of the daughter board 128 (i.e. the impedance transformer) is adapted to the disposition of the components on the mother board 130. Thus, thanks to the cut-outs 110, 112 of the multilayer circuit 60, the daughter board 128 lies above the impedance matching components 160, 162 of the transistors in the integrated 132 soldered to the mother board 130 whilst enabling access thereto.

The multilayer circuit transformer of the invention has the following advantages:

- a small overall size, in particular at the level of the connections on the mother board, compared to prior art transformers, notably because of the proposed topology; this enables a board with cut-outs to lie over components on the mother board circuit (or interconnection circuit) at the same time as complying with severe height constraints imposed in some equipment,
- excellent reproducibility compared to current solutions that are wired by hand,
- reduced cost of RF amplifiers or devices using the transformer of the invention because manual wiring operations are replaced by simplified attachment of a daughter board (the transformer) which is itself relatively simple and small; the cost of the daughter board (and the associated saving) depend on the quantities manufactured.

The impedance transformer of the invention is adapted to pass high powers, of the order of a few watts, with low radio-frequency losses.

The invention claimed is:

1. An impedance transformer operating in the VHF and UHF frequency bands, the impedance transformer comprising:

- a parallel low-impedance access Eb and a serial high-impedance access Eh, both intended to be connected to a printed circuit; and
- a multilayer circuit comprising:
  - a long side for its connection to the printed circuit;
  - at least three layers;
  - a first outer layer separated from a second outer layer (Ce2) of the same thickness by at least one inner layer of thickness at least four times greater than the thickness of the outer layers, each outer layer having two metalized faces to form electrical conductors;
  - an internal face including an internal electrical conductor;
  - an external face including an external electrical conductor facing the internal electrical conductor to form a microstrip line on each of the two outer layers, the two microstrip lines being symmetrical with respect to a central plane of the multilayer circuit parallel to the external faces;
    - at two facing ends of the microstrip lines, a respective electrical connection between the end of the internal conductor of one microstrip line and the end of the external conductor of the other microstrip line to produce the parallel low-impedance access Eb; and
    - at the facing other two ends of said microstrip lines, another electrical connection between the ends of the internal electrical conductors of the two microstrip lines, to produce the serial high-impedance access Eh,
- wherein both ends of the microstrip lines, respectively including the parallel low-impedance access Eb and the serial high-impedance access Eh, being on the long side of the multilayer circuit and close to each other to limit the area of connection with the printed circuit.

2. The VHF/UHF impedance transformer as claimed in claim 1, wherein the symmetrical microstrip lines have impedances varying progressively between their two ends from a low impedance to a high impedance in order to modify an impedance transformation ratio.

3. The VHF/UHF impedance transformers as claimed in claim 1, wherein the inner layer comprises two superposed layers, to form a perfectly symmetrical multilayer circuit with four layers.

4. The VHF/UHF impedance transformer as claimed in claim 1, wherein the electrical conductors of the microstrip lines are at least partially of serpentine shape along a common axis parallel to the long side of the multilayer circuit including the high-impedance access Eh and the low-impedance access Eb, to reduce the size of the multilayer circuit.

5. The VHF/UHF impedance transformer as claimed in claim 1, wherein the widths of the external and internal electrical conductors vary progressively from one of their ends to the other along the microstrip lines, from a certain initial width to a smaller final width to obtain a progressive variation from the low impedance to the high impedance of the microstrip lines.

6. The VHF/UHF impedance transformer as claimed in claim 1, wherein the electrical conductors of the microstrip lines include:

straight first parts perpendicular to the long side of the multilayer circuit including the ends of the electrical conductors forming the high-impedance access Eh and the low-impedance access Eb;

second parts, on either side of the high-impedance access Eh and the low-impedance access Eb, of serpentine shape along an axis parallel to the long side of the multilayer circuit; and straight third portions parallel to the axis over the portions of the electrical conductors of serpentine shape.

7. The VHF/UHF impedance transformers as claimed in claim 1, wherein the long side of the multilayer circuit includes a respective cut-out, on either side of the high-impedance access Eh and the low-impedance access Eb, of depth P having edges parallel to the long side, said cut-outs leaving room, under the transformer, for any components situated on the printed circuit to which the transformer is intended to be connected.

8. The VHF/UHF impedance transformer as claimed in claim 1, wherein the thickness of each of the outer layers is 100 μm, and the thickness of the inner layer is 1600 μm.

9. The VHF/UHF impedance transformer as claimed in claim 8, wherein the inner layer is formed by two superposed inner layers each 800 μm thick.

10. The VHF/UHF impedance transformer as claimed in claim 1, wherein a transformation ratio Rz between the impedance of the high-impedance access Eh and the low-impedance access Eb is in the range 2 to 9.

* * * * *